United States Patent [19]

Hochstrasser et al.

[11] 4,300,296

[45] Nov. 17, 1981

[54] IRONING PRESS

[75] Inventors: Walter P. Hochstrasser, Bernex; Georges Schumacher, Vernier, both of Switzerland

[73] Assignee: Mefina S.A., Fribourg, Switzerland

[21] Appl. No.: 132,186

[22] Filed: Mar. 20, 1980

[30] Foreign Application Priority Data

Apr. 11, 1979 [CH] Switzerland ..... 3457/79

[51] Int. Cl.[3] ..... D06F 71/00; D06F 71/08

[52] U.S. Cl. ..... 38/17; 38/27

[58] Field of Search ..... 38/14–17, 38/23–30, 33, 41

[56] References Cited

U.S. PATENT DOCUMENTS 3,590,502 5/1969 Hentschel ..... 38/28

3,715,820 2/1973 Hentschel ..... 38/17

3,757,440 9/1973 Fresard et al. ..... 38/17

3,877,161 4/1975 Engelhart ..... 38/17

3,990,164 11/1976 Hammer et al. ..... 38/17 X

*Primary Examiner*—Louis Rimrodt

*Attorney, Agent, or Firm*—Emory L. Groff, Jr.

[57] ABSTRACT

In an ironing press the heating plate is suspended in a pivotal manner on the arm of the press by the intermediary of two sliders each engaged in a bore of the arm. The lower end of each slider presents a diammetrical hole engaged with a stirrup, mounted on a profile or section solid with the heating plate.

Thus, when the heating plate is lowered onto the ironing board, it can adapt its position with respect to this latter, taking into account the differences in thickness of the article to be ironed.

6 Claims, 5 Drawing Figures

FIG. 1
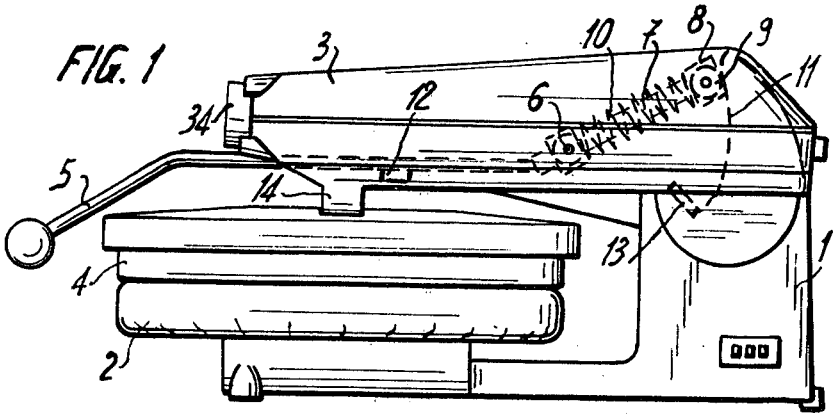
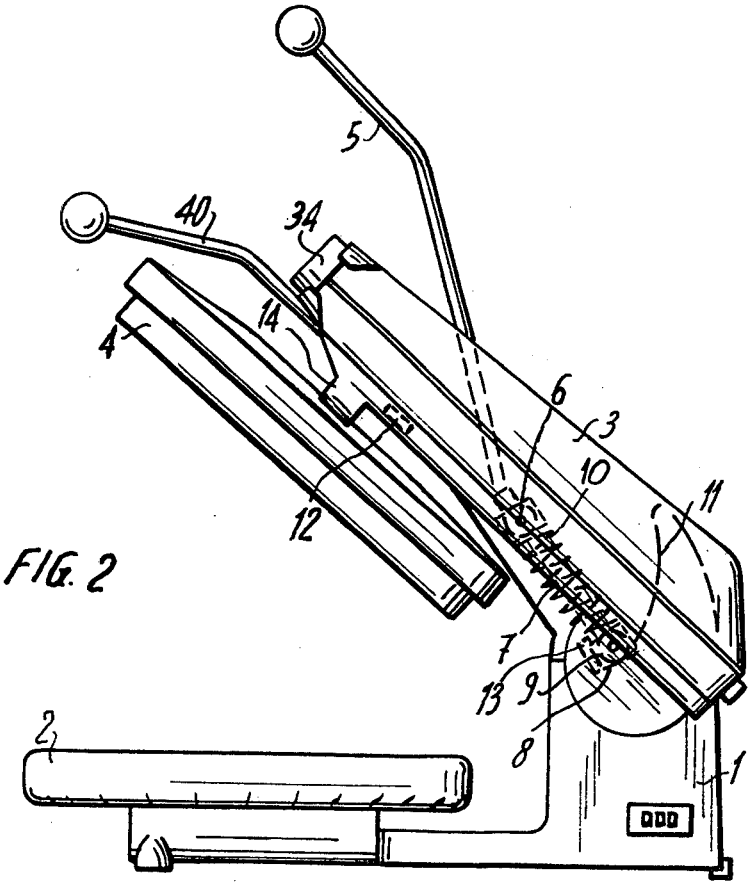
FIG. 2

IRONING PRESS

The present invention concerns an ironing press comprising a support for a buck or working surface, an arm mounted on the support to be pivoted about a horizontal axis, a heating pressing head or plate suspended in a pivotal manner from the arm and a lever pivoted to the arm at a point remote from the said horizontal axis, in which the pivoted suspension of the heating plate to the arm permits it to oscillate, on the one hand, against the action of return members about an axis perpendicular to the horizontal axis of the arm and, on the other hand, about an axis parallel to the horizontal axis of the arm, the said return members comprising two sliders mounted in two bores formed in the arm substantially at right angles with respect to the pivotal axis of the arm to the support.

A press of this type has already been described in the U.S. Pat. No. 3,757,440 in which the upper surface of the heating plate has two bosses each presenting a bore in which a pivot is engaged. These bores are coaxial and parallel to the longitudinal axis of the heating plate. Each of the pivots is pivoted at one of its ends with the lower end of one of the spring biassed sliders mounted in the bores in the arm to which the heating plate is also suspended in a pivotal manner.

The object of the invention is to simplify this pivotal suspension connection of the heating plate to the arm of the press.

According to the present invention there is provided an ironing press comprising a support for a working surface, an arm pivotally secured to the support about a horizontal axis, a pressing head or heating plate pivotally suspended from the arm and a lever pivotally secured to the arm at a point remote from the said horizontal axis, in which pivoted suspension means connecting the heating plate with the arm permits the plate to oscillate against the action of the return means along an axis perpendicular to the horizontal axis of the arm and also about an axis parallel to the horizontal axis of the arm; said return means comprising two sliders mounted in two bores provided in the arm substantially at right angles with respect to the pivotal axis of the arm with the support, characterized in that the end of each of the sliders adapted to be connected to the heating plate has a hole by which it is engaed on a stirrup, the arms of which stirrup are solid with the heating plate.

Preferably, the stirrup is constituted by a metallic rod of circular cross-section and the hole of the sliders is flared outwardly at its edges.

The invention will be described further, by way of example, with reference to the accompanying drawings in which:

FIGS. 1 and 2 are side elevational views, respectively in the closed and open positions.

Figure 3:
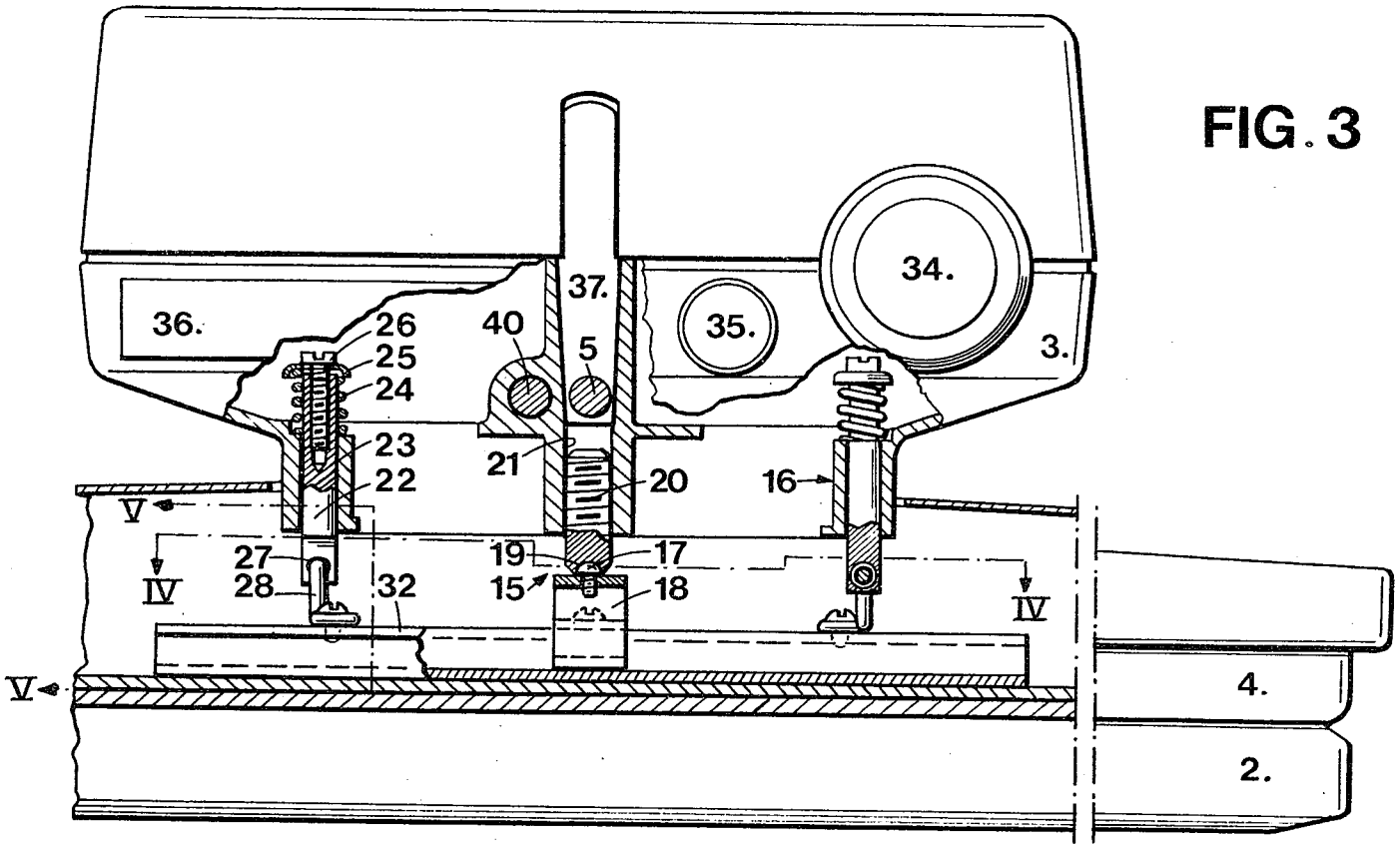
FIG. 3 is a view partly in section, representing the suspension means for suspending the heating plate from the pivotal arm of the press.

The ironing press illustrated in FIGS. 1 and 2 comprises a frame 1 serving to support a buck or ironing board 2 covered with fabric. An arm 3, from which is suspended a heating pressing plate 4 forming a sad-iron or smoothing-iron, is pivotally mounted at its rear end on the frame 1 and pivotal about a horizontal axis. A manual control lever 5 is pivotally secured to the arm 3 at a point 6 remote from said horizontal axis.

This lever 5 includes an extension 7 above and beyond its pivot point 6 and the extension carries a slider 8 provided with two rollers 9 in contact with the peripheries of two identical co-operating cams 11 carried by the frame 1.

The lever 5, and with it the arm 3, can occupy two stable positions—one corresponding to the closed condition of the press (see FIG. 1) and the other corresponding to the open condition of the press (see FIG. 2). It is maintained in either of these two positions by the spring 10 since this latter is less compressed in its two end or extreme positions than in any intermediate position by the slider 8 and rollers 9 bearing on the peripheries of the cams 11. In the closed position of the press, the lever 5 abuts furthermore against an elastic or resilient stop member 12 and in the open position of the press, the slider 8 abuts against an elastic stop member 13.

A suspension device 14 connecting the heating plate 4 with the arm 3 includes a ball and socket joint or swivel joint 15 maintained in position by two elastic or resilient means 16 of the resilient suspension disposed one on each side of the coupling 15.

As shown in FIG. 3, the swivel or ball 17 of the joint 15 is mounted on a support 18 secured to the upper surface of the heating plate 4 whilst its housing 19 forms a recess in one of the ends of a screw 20 adapted to adjust the distance of the heating plate 4 from the arm 3, against the action of the two suspension means 16. This screw 20 is engaged in an internally threaded bore 21 in the arm 3, as the screw 20 is turned to extend out of the bore 21, the more the heating plate 4 is spaced from the arm 3 and the greater is the pressure exerted on the ironing board 2 by the heating plate 4.

The suspension means 16 each comprise a slider 22 engaging in a bore 23 formed in the arm 3 at right angles with respect to the horizontal pivotal axis of the arm 3 to the frame 1 when the frame is closed. A coil spring 24 surrounding the upper end of each of the sliders 22, bears at one end on the upper edge of the bore 23 and at the other end against an end washer 25 of the slider 22, maintained in place by a screw 26, engaged in the axis of this latter.

Each slider 22 has a bore 27 which is flared at its edges and at its lower end the slider is engaged with a stirrup 28 whose ends 29 are inwardly curved in such a manner as to permit their securing by means of a screw 30 to the longitudinal edges 31 of a profile or section member 32 of U-shaped cross-section, secured at the base of the U to the heating plate 4. The support 18 of the ball 17 of the joint 15 is likewise constituted by a stirrup, the ends of which are screwed to the longitudinal edges of the member 32.

The suspension device 14 permits the heating plate 4, when it is lowered onto the ironing board 2, to adapt its position with respect to this latter, taking into account differences in thickness of the article to bhe ironed. It ensures thus a uniform distribution of the pressure during ironing and the return of the heating plate into its initial rest position, adjustable by means of screws 26.

The upper part of the arm 3 encloses devices for adjusting the temperature of the heating means. The button 34 for regulating a thermostat and control lights 35, 36, co-operating therewith are shown in FIG. 3.

Figure 4:
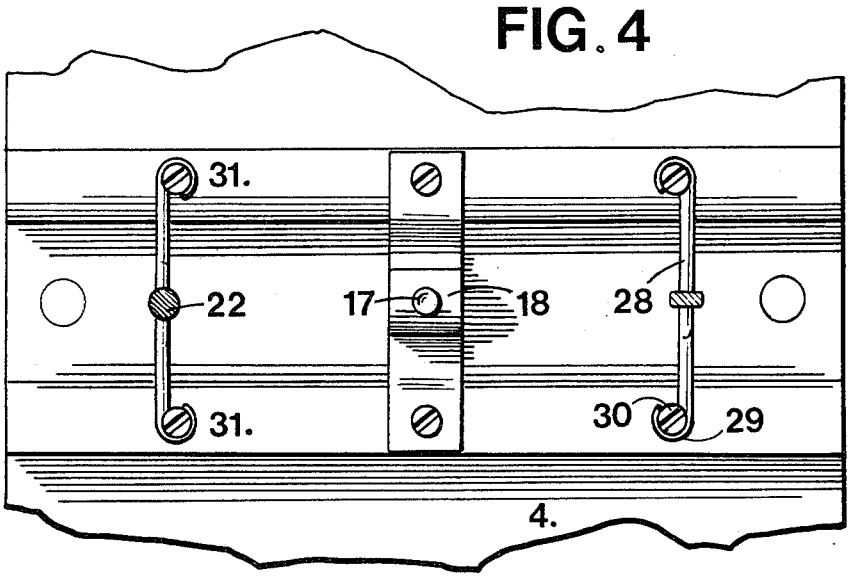
FIG. 4 is a partial view from above of the heating plate taken along IV—IV of FIG. 3.
Figure 5:
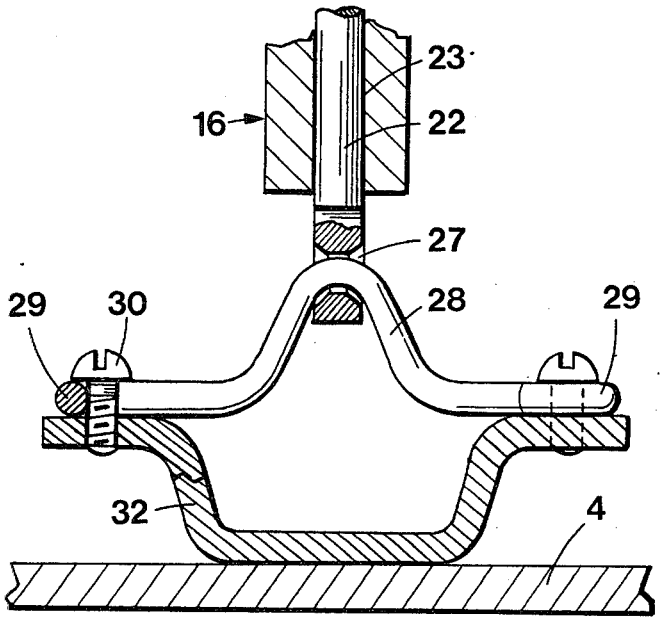
FIG. 5 is a partial view, on an enlarged scale, in section along the line V—V of FIG. 3, of the suspension means for suspending the heating plate from the arm of the press.

As shown in FIGS. 3 and 4, the arm 3 is provided furthermore with a throat or slot 37, in which the lever 5 is engaged in the closed condition of the press.

As shown in the drawings, a second lever 40 is provided rigid with the arm 3 of the press, said lever providng means for bringing the heating plate 4 closer to the ironing board 2 by one hand, before bringing the lever 5 into the closed condition of the press with the other hand.

Numerous modifications of the pivotal suspension of the heating plate 4 on the arm 3 can be envisaged. The stirrup 28 could, for example, be directly secured to the upper face of the heating plate 4 by means of screws 20 either transversally to the said plate, or longitudinally along an axis substantially medial to this latter.

Instead of disposing the elastic return members 16 on each side of the swivel coupling 15 such as described and shown in the drawing, the free ends of the sliders 22 may be connected to the ends of a beam mounted on a support, made integral with the arm 3 in an equidistant manner between the bores 23 and the arm 3 and omitting the joint 15. In this case, the springs 24 of the elastic return members 16 could also be omitted.

We claim:

1. An ironing press comprising a support for a working surface, an arm pivotally secured to the support about a horizontal axis, a pressing head or heating plate pivotally suspended from the arm and a lever pivotally secured to the arm at a point remote from the said horizontal axis, in which pivoted suspension means connecting the heating plate with the arm permits the plate to oscillate against the action of the return means along an axis perpendicular to the horizontal axis of the arm and also about an axis parallel to the horizontal axis of the arm; said return means comprising two sliders mounted in two bores provided in the arm substantially at right angles with respect to the pivotal axis of the arm with the support, characterized in that the end of each of the sliders adapted to be connected to the heating plate has a hole by which it is engaged on a stirrup, the arms of which stirrup are solid with the heating plate.

2. A press in accordance with claim 1, characterised in that the stirrup is constituted by a metallic wire of circular cross-section.

3. A press in accordance with claims 1 or 2, characterised in that the hole in each of the sliders is flared at its edges.

4. A press in accordance with claim 1, characterised in that the stirrups are disposed transversally to the heating plate.

5. A press in accordance with claims 1 or 4, characterised in that the end of the arms of the stirrups are secured to the longitudinal edges of a profile or section of U-shaped cross-section disposed substantially in the medial longitudinal axis of the heating plate and secured to this latter at the base of the U.

6. A press in accordance with claim 1, characterised in that the stirrups are secured to the heating plate along a longitudinal axis substantially median to this latter.

* * * * *